US007812272B2

(12) United States Patent
Fleege et al.

(10) Patent No.: US 7,812,272 B2
(45) Date of Patent: Oct. 12, 2010

(54) CIRCUIT BREAKER MECHANISM TO FACILITATE AUTOMATED ASSEMBLY

(76) Inventors: Dennis William Fleege, 1002 Quarry Ave. SW., Cedar Rapids, IA (US) 52404; Eugene Walter Wehr, 2510 29 St. SW., Cedar Rapids, IA (US) 52404

( * ) Notice: Subject to any disclaimer, the term of this patent is extended or adjusted under 35 U.S.C. 154(b) by 911 days.

(21) Appl. No.: 11/521,910

(22) Filed: Sep. 15, 2006

(65) Prior Publication Data

US 2008/0067047 A1 Mar. 20, 2008

(51) Int. Cl.
*H01H 9/00* (2006.01)
*H01H 19/62* (2006.01)
*H01H 27/00* (2006.01)

(52) U.S. Cl. ..... 200/17 R; 200/401

(58) Field of Classification Search ..... 200/17 R
See application file for complete search history.

(56) References Cited

U.S. PATENT DOCUMENTS 3,464,040 A 8/1969 Powell
4,011,420 A 3/1977 Heft
4,232,282 A 11/1980 Menocal
4,513,268 A 4/1985 Seymour et al.
5,302,787 A * 4/1994 Edds et al. ..... 200/401
5,692,599 A * 12/1997 Winter ..... 200/401
5,836,441 A * 11/1998 Scheel et al. ..... 200/17 R
5,847,913 A 12/1998 Turner et al.
5,946,179 A 8/1999 Fleege et al.
6,482,048 B1 11/2002 Fleege et al.

* cited by examiner

*Primary Examiner*—Michael A Friedhofer
*Assistant Examiner*—Lheiren Mae A Caroc

(57) ABSTRACT

A layered mechanism for use in a circuit breaker fabricated by automated assembly operations includes a movable electrical contact mounted on a blade for movement relative to a stationary electrical contact. The major portion of the blade is substantially flat, and a handle is coupled to the blade to move said blade. A toggle spring is connected to the blade to apply a biasing force in the plane of the flat portion of the blade. The handle and blade form cooperating opposed surfaces that allow engagement of the handle with the blade so that movement of the handle can move the blade while allowing pivoting movement of the blade relative to the handle, while opposed surfaces resist upward pivoting movement of the blade when the toggle spring is attached to the blade during assembly of the circuit breaker.

17 Claims, 4 Drawing Sheets

CIRCUIT BREAKER MECHANISM TO FACILITATE AUTOMATED ASSEMBLY

FIELD OF THE INVENTION

This invention is directed generally to circuit breaker mechanisms that are fabricated by automated assembly operations and, more particularly, to layered mechanisms for use in thin single-pole or multi-pole circuit breakers.

SUMMARY OF THE INVENTION

In one embodiment of the present invention, a layered mechanism for use in a circuit breaker fabricated by automated assembly operations comprises a movable electrical contact mounted on a blade for movement relative to a stationary electrical contact. The major portion of the blade is substantially flat, and a handle is coupled to the blade to move said blade. A toggle spring is connected to the blade to apply a biasing force in the plane of the flat portion of the blade. The handle and blade form cooperating opposed surfaces that allow engagement of the handle with the blade so that movement of the handle can move the blade while allowing pivoting movement of the blade relative to the handle, while opposed surfaces resist upward pivoting movement of the blade when the toggle spring is attached to the blade during assembly of the circuit breaker.

In one implementation, opposed surfaces of the handle and blade form a generally V-shaped notch in the handle, and an integral tab extending upwardly from the plane of the substantially flat portion of the blade and adapted to fit into the notch to allow pivoting movement of the blade relative to the handle within the plane of the substantially flat portion of the blade. The flat portion of the blade adjacent the tab extends under the handle to resist upward pivoting movement of the blade, out of the plane of the substantially flat portion of the blade, when the toggle spring is attached to the blade during assembly of the circuit breaker. The toggle spring extends along the upper surface of the blade, and the tab and the throat of the V-shaped notch form opposed engaging surfaces so that the fulcrum for upward pivoting movement of the blade is located at the upper end of the opposed engaging surfaces, closer to the axis of the toggle spring than the substantially flat major portion of the blade.

In another implementation, the tab and the throat of the notch form opposed engaging surfaces that include a notch in the surface of the blade and a mating rib on the surface of the handle, to control the positions of the blade and handle in a direction orthogonal to the plane of the substantially flat portion of the blade.

In another implementation, the tab forms a cantilevered portion extending toward the handle from the substantially flat major portion of the blade, the lower edge of the cantilevered portion forming a generally rectangular notch, and the handle includes a cross member extending across the mouth of the V-shaped notch and mating with the generally rectangular notch. Opposed engaging surfaces of the generally rectangular notch and the cross member resist upward pivoting movement of the blade when the toggle spring is attached to the blade during assembly of the circuit breaker.

A further implementation includes a trip lever, and the toggle spring is connected between the trip lever and the blade. The trip lever has a notch in one edge thereof, and the spring end that is connected to the trip lever forms a bent portion that extends through the notch in the trip lever and terminates in a substantially closed loop that extends beyond opposed edges of the notch in the trip lever to attach the spring to the trip lever.

BRIEF DESCRIPTION OF THE DRAWINGS

The invention may best be understood by reference to the following description taken in conjunction with the accompanying drawings, in which.

DETAILED DESCRIPTION OF THE ILLUSTRATED EMBODIMENT

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 1:
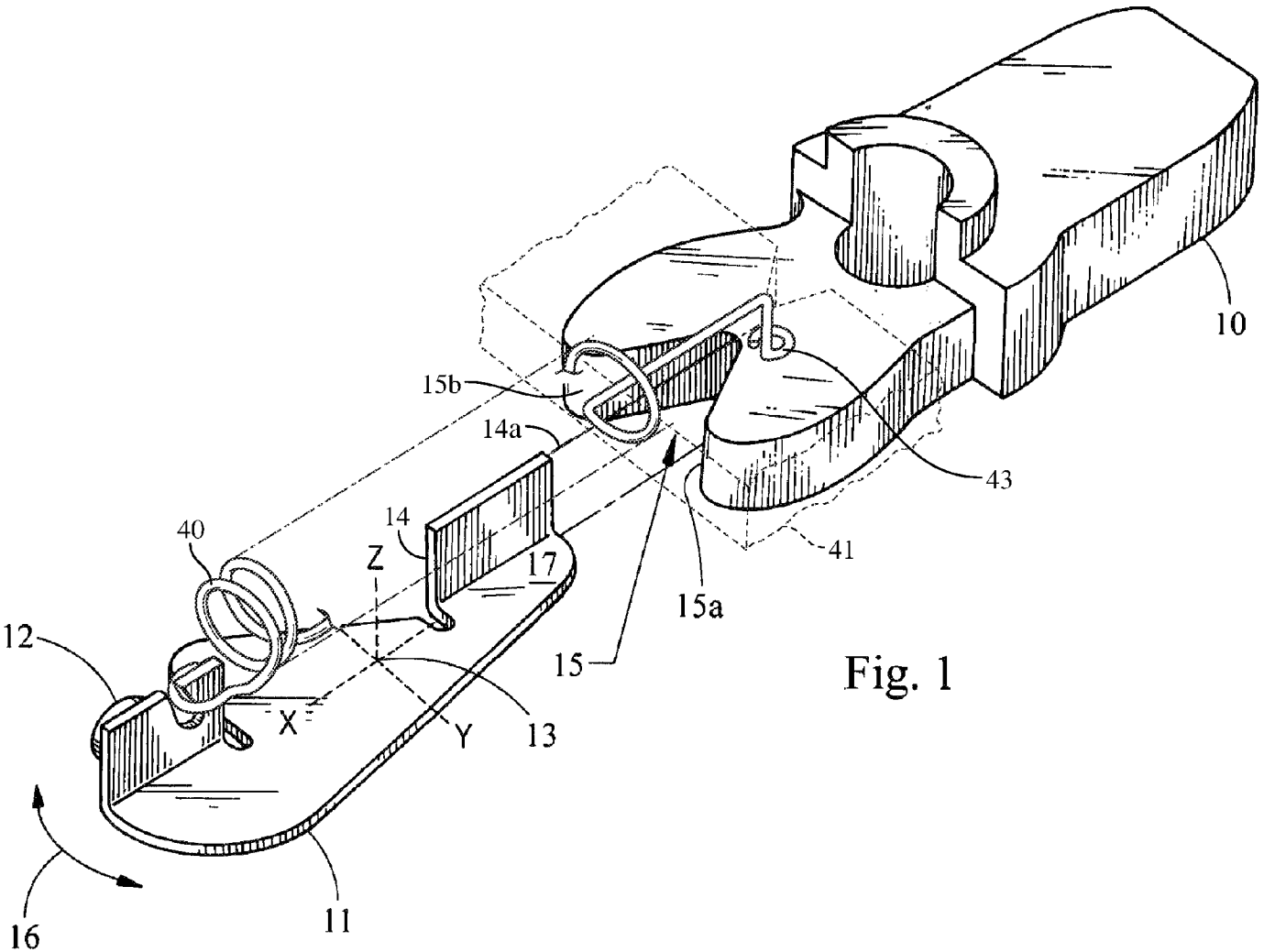
FIG. 1 is an exploded perspective view of mating blade and handle components for use in a circuit breaker having a layered construction.
Figure 2:
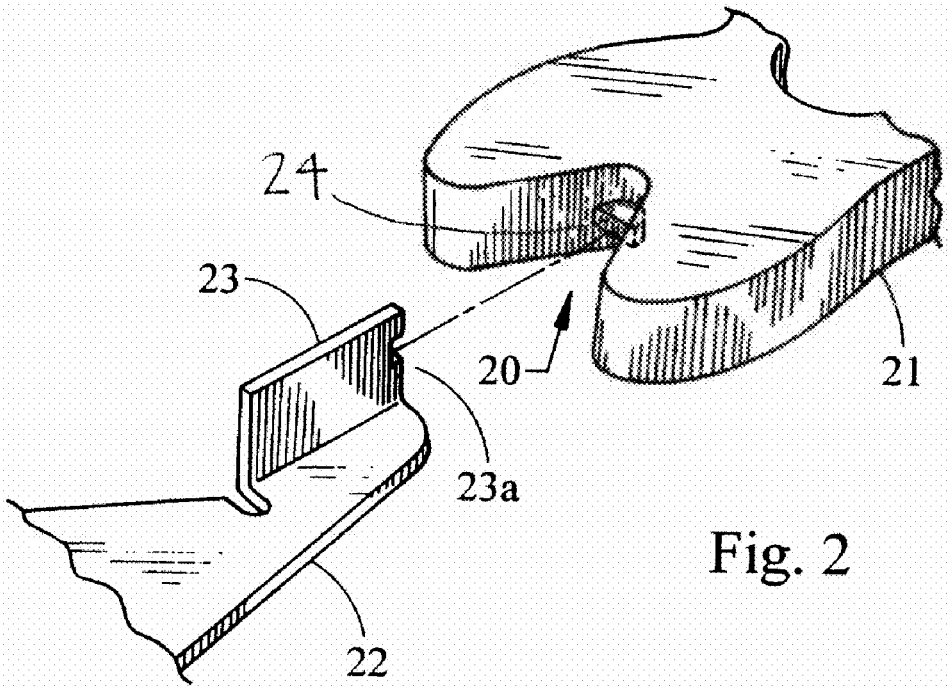
FIG. 2 is an exploded perspective view of mating end portions of a modified pair of blade and handle components for use a circuit breaker having a layered construction.

Referring now to the drawings, FIGS. 1 and 2 illustrate a handle 10 and blade 11 for use in a circuit breaker of the type described in U.S. Pat. Nos. 5,946,179 and 6,482,048. The blade 11 carries a movable electrical contact 12 that is moved into and out of engagement with a stationary electrical contact (not shown) when the blade is pivoted about an axis 13. Pivoting movement of the blade is effected by the handle 10 and/or a toggle spring (not shown) connected to the blade 11 to apply a biasing force to the blade.

To facilitate automated assembly, the components of a circuit breaker utilizing the handle 10 and blade 11 are typically designed with a "layered" structure, so that the various components can be assembled sequentially on the base of the circuit breaker. The components extend primarily in X and Y directions, parallel to the base of the circuit breaker, and are layered in a Z direction that is orthogonal to the X and Y directions and that determines the thickness of the circuit breaker.

The handle 10 and blade 11 are coupled in a manner that causes the blade 11 to be pivoted whenever the handle 10 is pivoted, while also permitting pivoting movement of the blade 11 relative to the handle 10. In the illustrative embodiment, the blade 11 forms an integral tab 14 extending upwardly, in the Z direction, from the main body of the blade, which lies in an X-Y plane. During assembly, the blade 11 is inserted into the circuit breaker assembly before the handle 10, and the handle is positioned so that the tab 14 fits into a generally V-shaped notch 15 in the end of the handle 10. The notch 15 allows pivoting movement of the blade 11 relative to the handle 10, while still coupling the handle to the blade 11 via the tab 14 so that the handle 10 can be used to move the blade 11. For example, when the handle 10 is pivoted in the clockwise direction, as viewed in FIG. 1, the notch surface 15*a* engages the tab 14 to pivot the blade 11 in the counterclockwise direction. Conversely, when the handle 10 is pivoted in the counterclockwise direction, as viewed in FIG. 1, the notch surface 15*b* engages the tab 14 to pivot the blade 11 in the clockwise direction.

One of the advantages of the arrangement shown in FIG. 1 is that it helps to stabilize the blade 11 when the toggle spring is attached to the blade 11, after installation of the handle 10. The fact that the axis of the toggle spring lies in a plane above that of the blade 11, and that the toggle spring is attached to the end of the blade that carries the contact 12, means that the toggle spring applies a lifting force to the contact end of the blade, tending to tilt the contact end of the blade 11 upwardly, in the Z direction, as indicated by the arrow 16 in FIG. 1. However, portion 17 of the blade body, adjacent the tab 14, extends under the portion of the handle 10 adjacent the notch surface 15*a*, which resists and lifting force applied to the blade by the toggle spring during assembly. Furthermore, the fulcrum for any upward tilting of the contact end of the blade 11 is where the upper corner 14*a* of the tab 14 engages the upper end of the notch 15, which is closer to the axis of the toggle spring and thus reduces the moment arm of any Z-direction force applied to the blade 11 by the toggle spring, thereby reducing the force that must be resisted to stabilize the blade 11 during assembly.

FIG. 2 illustrates a modified embodiment in which one side of a notch 20 in a handle 21 is shortened to reduce the friction between overlapping surfaces of the handle 21 and a blade 22. In addition, the tab 23 formed by the blade 22 includes a notch 23*a* that fits over a complementary rib 24 in the throat of the notch 20 to control the position of the blade 22 relative to the handle 21 in the Z direction.

Figure 3:
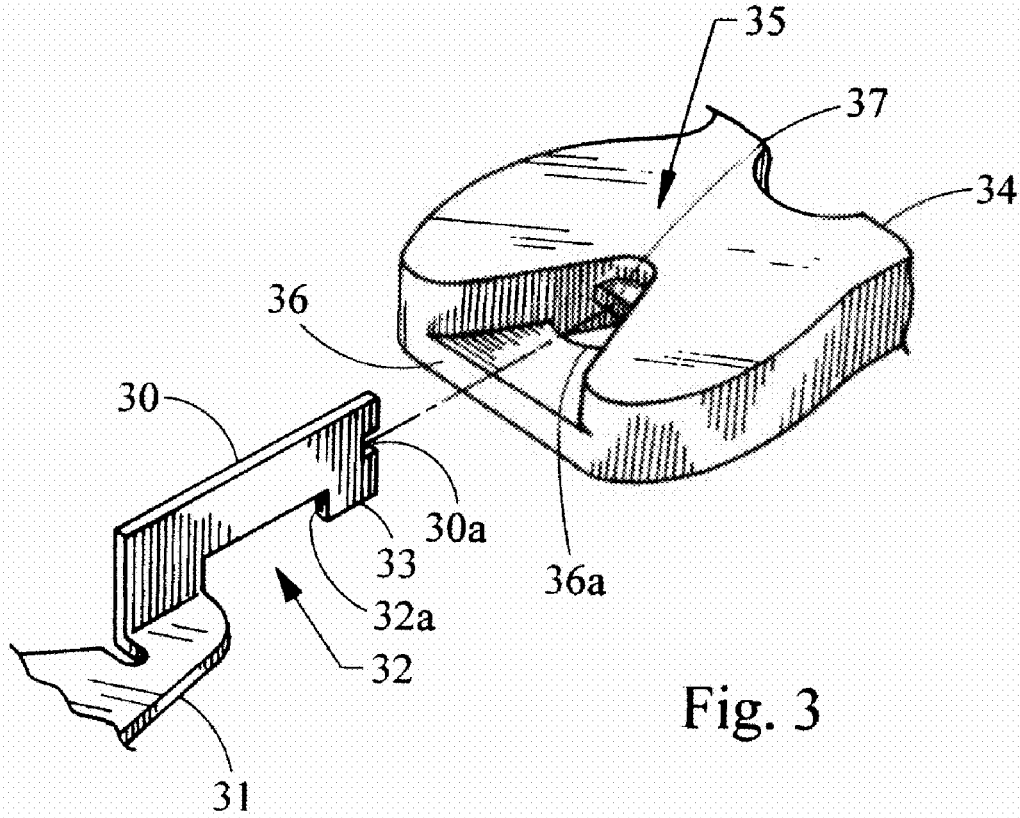
FIG. 3 is an exploded perspective view of mating end portions of another modified pair of blade and handle components for use in a circuit breaker having a layered construction.
Figure 4A:
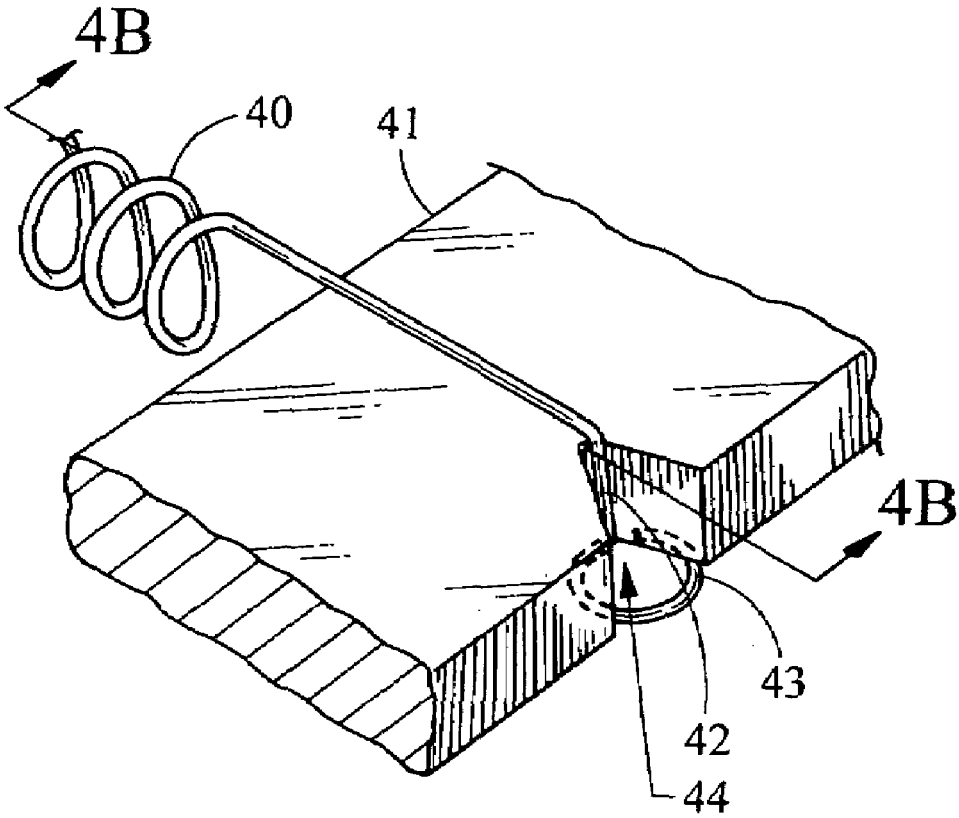
FIG. 4*a* is an perspective view of adjacent portions of toggle spring and trip lever components for use in a circuit breaker having a layered construction.
Figure 4B:
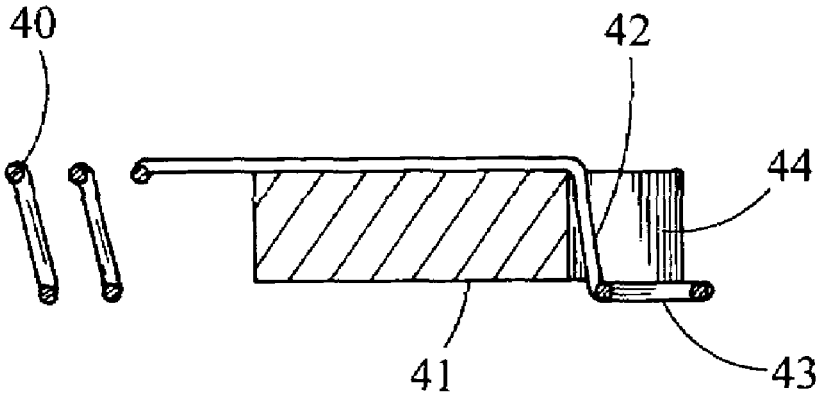
FIG. 4*b* is a section taken along line 4-4*b* in FIG. 4*a*.
Figure 4C:
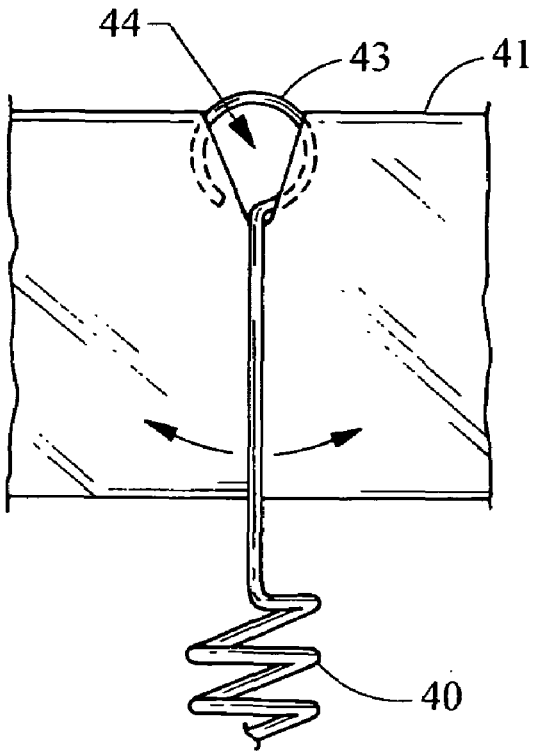
FIG. 4*c* is a top plan view of the toggle spring and trip lever components shown in FIG. 4*a*.
Figure 4D:
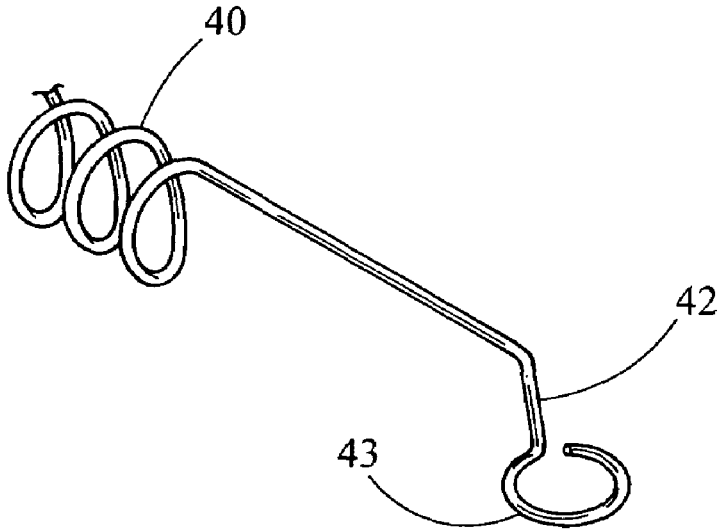
FIG. 4*d* is a perspective view of the toggle spring component of FIGS. 4*a*-4*c*.

FIG. 3 illustrates another modified embodiment in which a tab 30 extends beyond the tab end of the body portion of a blade 31 so that a rectangular notch 32 can be formed in the lower edge of the tab 30. This forms a depending leg 33 on the front end of the tab 30. The mating handle 34 forms a notch 35 which extends through the full thickness of the handle only in the throat of the notch, thereby forming a cross member 36 that extends across the lower portion of the mouth of the notch. When the blade 31 and handle 34 are assembled, the notch 32 in the lower edge of the tab 30 fits over the cross member 36, so that any upward tilting force subsequently applied to the blade 31 by the toggle spring is resisted by engagement of the notch surface 32*a* with the inboard surface 36*a* of the cross member 36, thereby stabilizing the blade against tilting movement in the Z direction. As in the embodiment of FIG. 2, the tab 30 includes a notch 30*a* that fits over a complementary rib 37 in the throat of the notch 35 to control the position of the blade 30 relative to the handle 34 in the Z direction.

The toggle spring referred to above is attached at one end to the blade that carries the movable electrical contact, and at the other end to a trip lever. FIGS. 4*a*-4*d* illustrate an improved structure for attaching the end of a toggle spring 40 to a trip lever 41. Rather than forming a hook, the end of the spring 40 is bent downwardly to form a leg 42 extending in the Z direction, and then a substantially closed circular loop 43 lying in an X-Y plane. The mating portion of the trip lever 41 forms a V-shaped notch 44 so that when the leg 42 of the spring 40 is inserted into the throat of the notch 44, portions of the loop 43 overlap portions of the lower surface of the trip lever 41 along opposite edges of the notch 44. This provides a secure connection that is easy to assemble, and avoids the problems caused by the catching of open hooks during assembly operations.

While particular embodiments and applications of the present invention have been illustrated and described, it is to be understood that the invention is not limited to the precise construction and operation disclosed herein and that various modifications, changes, and variations may be apparent from the foregoing descriptions without departing from the spirit and scope of the invention as defined in the appended claims.

The invention claimed is:

1. A layered mechanism for use in a circuit breaker fabricated by automated assembly operations, comprising:

a movable electrical contact mounted on a blade for movement relative to a stationary electrical contact, the major portion of said blade being substantially flat, a handle coupled to said blade for moving said blade, a toggle spring connected to said blade to apply a biasing force to said blade in the plane of the substantially flat major portion of said blade, said handle and said blade forming cooperating opposed surfaces that allow engagement of said handle with said blade so that movement of said handle can move said blade while allowing pivoting movement of said blade relative to said handle within said plane, said opposed surfaces resisting upward pivoting movement of said blade out of said plane when said toggle spring is attached to said blade during assembly of said circuit breaker, wherein said opposed surfaces form a notch in said handle, said blade including an integral tab extending upwardly in a direction away from the plane of the substantially flat portion of said blade and adapted to fit into said notch to allow pivoting movement of said blade relative to said handle within said plane, the flat portion of said blade adjacent said integral tab extending and overlapping under said handle along said plane to resist upward pivoting movement of said blade out of said plane when said toggle spring is attached to said blade during assembly of said circuit breaker.

2. The layered mechanism of claim 1 wherein said notch is generally V-shaped.

3. The layered mechanism of claim 2 wherein said toggle spring extends along the upper surface of said blade, and said tab and a throat of said notch form opposed engaging surfaces so that the fulcrum for upward pivoting movement of said blade is located at the upper end of said opposed engaging surfaces, closer to the axis of said toggle spring than the substantially flat major portion of said blade.

4. The layered mechanism of claim 2 wherein said tab and a throat of said notch form opposed engaging surfaces that include a notch in the surface of said blade and a mating rib on the surface of said handle, to control the positions of said blade and handle in a direction orthogonal to the plane of the substantially flat portion of said blade.

5. The layered mechanism of claim 4 wherein said tab forms a cantilevered portion extending toward said handle from said substantially flat major portion of said blade, the lower edge of said cantilevered portion forming a generally rectangular notch, and said handle includes a cross member extending across a mouth of said V-shaped notch and mating with said generally rectangular notch so that opposed engaging surfaces of said generally rectangular notch and said cross member resist upward pivoting movement of said blade out of said plane when said toggle spring is attached to said blade during assembly of said circuit breaker.

6. The layered mechanism of claim 1 which includes a trip lever and said toggle spring is connected to said trip lever, said trip lever has a notch in one edge thereof, and the end of said spring that is connected to said trip lever forms a bent portion that extends through said notch in said trip lever and terminates in a substantially closed loop that extends beyond opposed edges of said notch in said trip lever to attach said spring to said trip lever.

7. The layered mechanism of claim 1 wherein said toggle spring extends along the upper surface of said blade, and said tab and a throat of said notch form opposed engaging surfaces so that the fulcrum for upward pivoting movement of said blade is located at the upper end of said opposed engaging surfaces, closer to the axis of said toggle spring than the substantially flat major portion of said blade.

8. A layered mechanism for use in a circuit breaker fabricated by automated assembly operations, comprising a movable electrical contact mounted on a blade for movement relative to a stationary electrical contact, the major portion of said blade being substantially flat, a handle coupled to said blade for moving said blade, a toggle spring connected to said blade to apply a biasing force to said blade in the plane of substantially flat major portion of said blade, said handle component forming a generally V-shaped notch, and said blade component forming an integral tab extending upwardly in a direction away from the plane of the substantially flat portion of said blade and adapted to fit into said notch to allow pivoting movement of said blade relative to said handle within said plane, the flat portion of said blade adjacent said integral tab extending and overlapping under said handle along said plane to resist upward pivoting movement of said blade out of said plane when said toggle spring is attached to said blade during assembly of said circuit breaker.

9. The layered mechanism of claim 8 wherein said toggle spring extends along the upper surface of said blade, and said tab and a throat of said notch form opposed engaging surfaces so that the fulcrum for upward pivoting movement of said blade is located at the upper end of said opposed engaging surfaces, closer to the axis of said toggle spring than the substantially flat major portion of said blade.

10. The layered mechanism of claim 8 wherein said tab and a throat of said notch form opposed engaging surfaces that include a notch in the surface of said blade and a mating rib on the surface of said handle, to control the positions of said blade and handle in a direction orthogonal to the plane of the substantially flat portion of said blade.

11. The layered mechanism of claim 10 wherein said tab forms a cantilevered portion extending toward said handle from said substantially flat major portion of said blade, the lower edge of said cantilevered portion forming a generally rectangular notch, and said handle includes a cross member extending across a mouth of said V-shaped notch and mating with said generally rectangular notch so that opposed engaging surfaces of said generally rectangular notch and said cross member resist upward pivoting movement of said blade out of said plane when said toggle spring is attached to said blade during assembly of said circuit breaker.

12. The layered mechanism of claim 8 which includes a trip lever, and said toggle spring is connected to said trip lever, said trip lever has a notch in one edge thereof, and the end of said spring that is connected to said trip lever forms a bent portion that extends through said notch in said trip lever and terminates in a substantially closed loop that extends beyond opposed edges of said notch in said trip lever to attach said spring to said trip lever.

13. A layered mechanism for use in a circuit breaker fabricated by automated assembly operations, comprising multiple layered components extending primarily in X and Y directions and layered in a Z direction that is orthogonal to the X and Y directions and that determines the thickness of the circuit breaker, a movable electrical contact mounted on a first layered component for movement relative to a stationary electrical contact, a second layered component coupled to said first layered component for moving said first layered component, a toggle spring connected to said first layered component to apply a biasing force to said first layered component in the X-Y plane, said second layered component forming a generally V-shaped notch, and said first layered component forming an integral tab extending in the Z direction from said first layered component and adapted to fit into said notch to allow pivoting movement of said first layered component relative to said second layered component in the X-Y plane, a portion of said first layered component adjacent said tab extending and overlapping under said second layered component along the X-Y plane to prevent said first layered component from pivoting in the Z direction when said toggle spring is attached to said first layered component during assembly of said circuit breaker.

14. The layered mechanism of claim 13 wherein said toggle spring extends along the upper surface of said first layered component, and said tab and a throat of said V-shaped notch form opposed engaging surfaces so that the fulcrum for pivoting movement of said first layered component in the Z direction is located at the upper end of said opposed engaging surfaces, closer to the axis of said toggle spring.

15. The layered mechanism of claim 13 wherein said tab and a throat of said V-shaped notch form opposed engaging surfaces that include a notch in the surface of said first layered component and a mating rib on the surface of said second layered component, to control the positions of said first layered component and second layered component in the Z direction.

16. The layered mechanism of claim 15 wherein said tab forms a cantilevered portion extending toward said second layered component from the portion of said first layered component lying in the X-Y plane, the lower edge of said cantilevered portion forming a generally rectangular notch, and said second layered component includes a cross member extending across a mouth of said V-shaped notch and mating with said generally rectangular notch so that opposed engaging surfaces of said generally rectangular notch and said cross member resist pivoting movement of said first layered component in the Z direction when said toggle spring is attached to said first layered component during assembly of said circuit breaker.

17. The layered mechanism of claim 13 which includes a trip lever and said toggle spring is connected to said trip lever, said trip lever has a notch in one edge thereof, and the end of said spring that is connected to said trip lever forms a bent portion that extends through said notch in said trip lever and terminates in a substantially closed loop that extends beyond opposed edges of said notch in said trip lever to attach said spring to said trip lever.

* * * * *